US006120263A

United States Patent [19]

Kosters

[11] Patent Number: 6,120,263

[45] Date of Patent: Sep. 19, 2000

[54] PERISTALTIC PUMPHEADS WHICH INDEPENDENTLY SUPPORTS A DRIVE ASSEMBLY

[75] Inventor: Johan G. M. Kosters, Bornerbroek, Netherlands

[73] Assignee: Bredel Hose Pumps B.V., Delden, Netherlands

[21] Appl. No.: 09/081,290

[22] Filed: May 19, 1998

[30] Foreign Application Priority Data

May 30, 1997 [GB] United Kingdom ..... 9711218

[51] Int. Cl.[7] ..... F04B 43/08

[52] U.S. Cl. ..... 417/477.1

[58] Field of Search ..... 417/359, 360, 417/477.1, 474, 476

[56] References Cited

U.S. PATENT DOCUMENTS

| | | | |
|---|---|---|---|
| 3,402,673 | 9/1968 | Ballentine et al. | 417/477.1 |
| 3,781,142 | 12/1973 | Zweig . | |
| 4,230,438 | 10/1980 | Lehmann et al. | 417/359 |
| 4,832,585 | 5/1989 | Horiuchi et al. | 417/477.1 |
| 5,356,267 | 10/1994 | Fulmer | 417/360 |
| 5,375,984 | 12/1994 | Wehling | 417/477.1 |

FOREIGN PATENT DOCUMENTS

| | | |
|---|---|---|
| 2 098 670 | 11/1982 | United Kingdom . |
| WO 88/05868 | 8/1988 | WIPO . |

*Primary Examiner*—Charles G. Freay
*Attorney, Agent, or Firm*—David C. Jenkins; Arnold B. Silverman; Eckert Seamans Cherin & Mellott, LLC

[57] ABSTRACT

A peristaltic pumphead (31) comprises a pumphead body (311), a flexible tube which extends through the body, a rotor (314) which engages with the tube, and a hub (318) which supports the rotor (314) for rotation within the pumphead body. The hub (318) is directly connected to or is integrally formed with the pumphead body. The pumphead body or the hub is adapted to support directly a drive assembly (33, 35).

24 Claims, 13 Drawing Sheets

PERISTALTIC PUMPHEADS WHICH INDEPENDENTLY SUPPORTS A DRIVE ASSEMBLY

FIELD OF THE INVENTION

The present invention relates to peristaltic pumpheads.

DESCRIPTION OF THE RELATED ART

Peristaltic pumps generally comprise a drive motor connected via a gearbox to drive a rotor housed in a pumphead. The rotor carries a pair of shoes or other means for engagement with a flexible tube. As the rotor rotates, the shoes deform the flexible tube to form an occlusion in the tube. As the occlusion moves along the length of the tube, fluid in the tube is forced from one end to the other.

Conventional pump drive systems either require highly accurate alignment of the rotor with the gearbox and motor which is time consuming and expensive, or do not allow straight-forward exchange of the gearbox and or motor without disturbance being caused to the pumphead itself.

SUMMARY OF THE PRESENT INVENTION

According to one aspect of the present invention, there is provided a peristaltic pumphead including a pumphead body and a rotor, the pumphead body including a hub on which the rotor is mounted for rotation within the pumphead body to create a peristaltic action in a flexible tube disposed between the rotor and the pumphead body, and a mounting portion for supporting a drive assembly, wherein, when the pumphead is in use, the rotor and drive assembly are supported independently by the pumphead body, the drive assembly being supported solely by the pumphead body, and a drive shaft extends through the hub so as to connect the drive assembly and the rotor.

In such a pumphead the flexible tube preferably extends out of the body to provide inlet and outlet ports of the pumphead, and the rotor acts to compress the tube. The driveshaft is for engagement with an outlet shaft of the drive assembly.

The driveshaft may extend unsupported through the hub, or may be supported on bearings within the hub.

The rotor may be supported on bearings on an outer surface of the hub. The rotor preferably comprises a main portion which carries tube engaging lobe portions and a central portion which carries the said driveshaft.

A seal may be provided between the hub and the rotor, and a wear ring may be located between the seal and the rotor, the wear ring being rotatable with the rotor.

Such a pumphead may include a lubricant drain path for allowing lubricant held in the pumphead body to drain away from the bearing in the event of seal failure.

According to another aspect of the present invention there is provided a peristaltic pumphead comprising a pumphead body, a flexible tube arranged within the body and extending out of the body to provide inlet and outlet ports of the pumphead, and a rotor which is engageable with the flexible tube, so as to compress the tube, wherein the pumphead body includes a hub which supports the rotor and about which the rotor is rotatable, the rotor being provided with a driveshaft which extends through the hub towards the outside of the pumphead, which driveshaft is for engagement with a output shaft of a drive assembly.

Thus, an embodiment of the present invention can provide a pumphead in which the rotor itself is supported by a hub which is fixed to or is part of the pumphead body. For example, it may comprise part of the pumphead casing. In this way, the rotor can remain in place even if the drive assembly is removed. The provision of bearings which support the rotor allows the rotor driveshaft to be unsupported as it extends through the hub. The gearbox can be bolted directly to the pumphead casing or to the hub itself, so that its output shaft can engage with the rotor driveshaft. This enables quick and simple alignment of the gearbox shaft with the rotor shaft, while allowing easy replacement of the gearbox/drive assembly.

Another aspect of the invention is the provision of a pumphead in which the rotor and drive assembly are independently supported by the pumphead and/or by a hub within the pumphead.

DETAILED DESCRIPTION OF THE PREFERRED EMBODIMENTS

Figure 1:
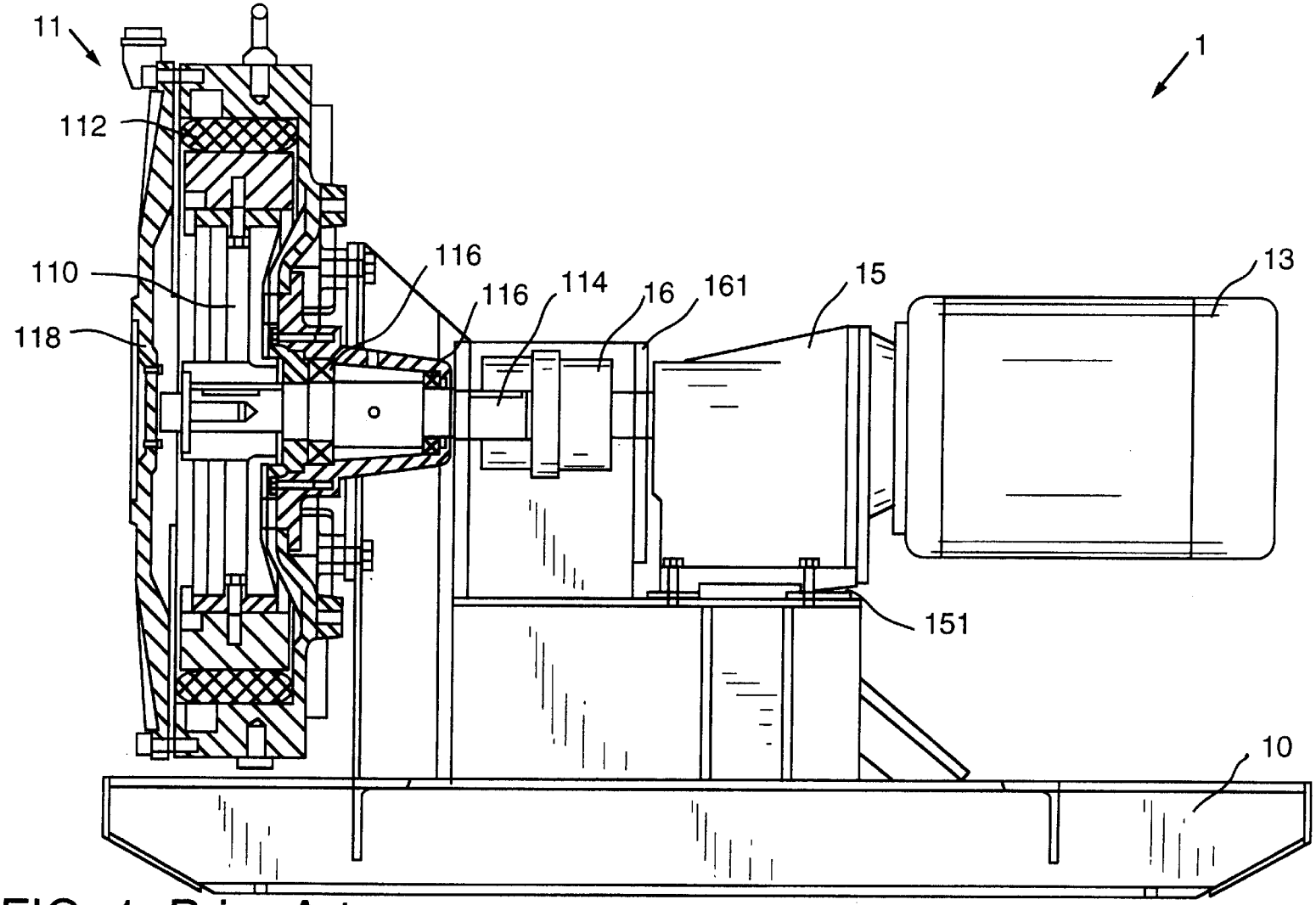
FIG. 1 Prior Art
FIG. 1 shows a side section view of a first prior art peristaltic pump.

The prior art peristaltic pump 1 shown in FIG. 1 comprises a pumphead 11 which is driven by a motor 13 via a gearbox 15 and a drive coupling 16. The motor 13, gearbox 15, coupling 16 and pumphead 11 are mounted on a base plate 10. The pumphead 11 includes a rotor 110 which is rotatable by the drive arrangement 13, 15 and 16. The rotor carries shoes for engagement with a flexible tube 112, which carries a fluid to be pumped through the tube as the rotor rotates. An occlusion is caused to move along the tube in order to pump the fluid. The rotor and tube are contained within the pumphead housing by a cover plate 118.

The rotor 110 is supported on integral bearings 116 and has a male input shaft 114. The shaft 114 is coupled to a gear motor assembly 13 and 15 by way of a drive coupling 16. The coupling is usually covered with a safety guard 161. The gear motor assembly 13, 15 must be accurately aligned with the input shaft and this is achieved using shims 151 under the gearbox mounting. The shims are individually machined or selected to size dependent upon the variation in height or alignment of the gear motor assembly to the input shaft. This alignment is required to be of high accuracy and is both time consuming and expensive to achieve. However, the advantage of this sort of pump arrangement is that the gear motor assembly can be exchanged without disturbing the pumphead assembly.

Figure 2:
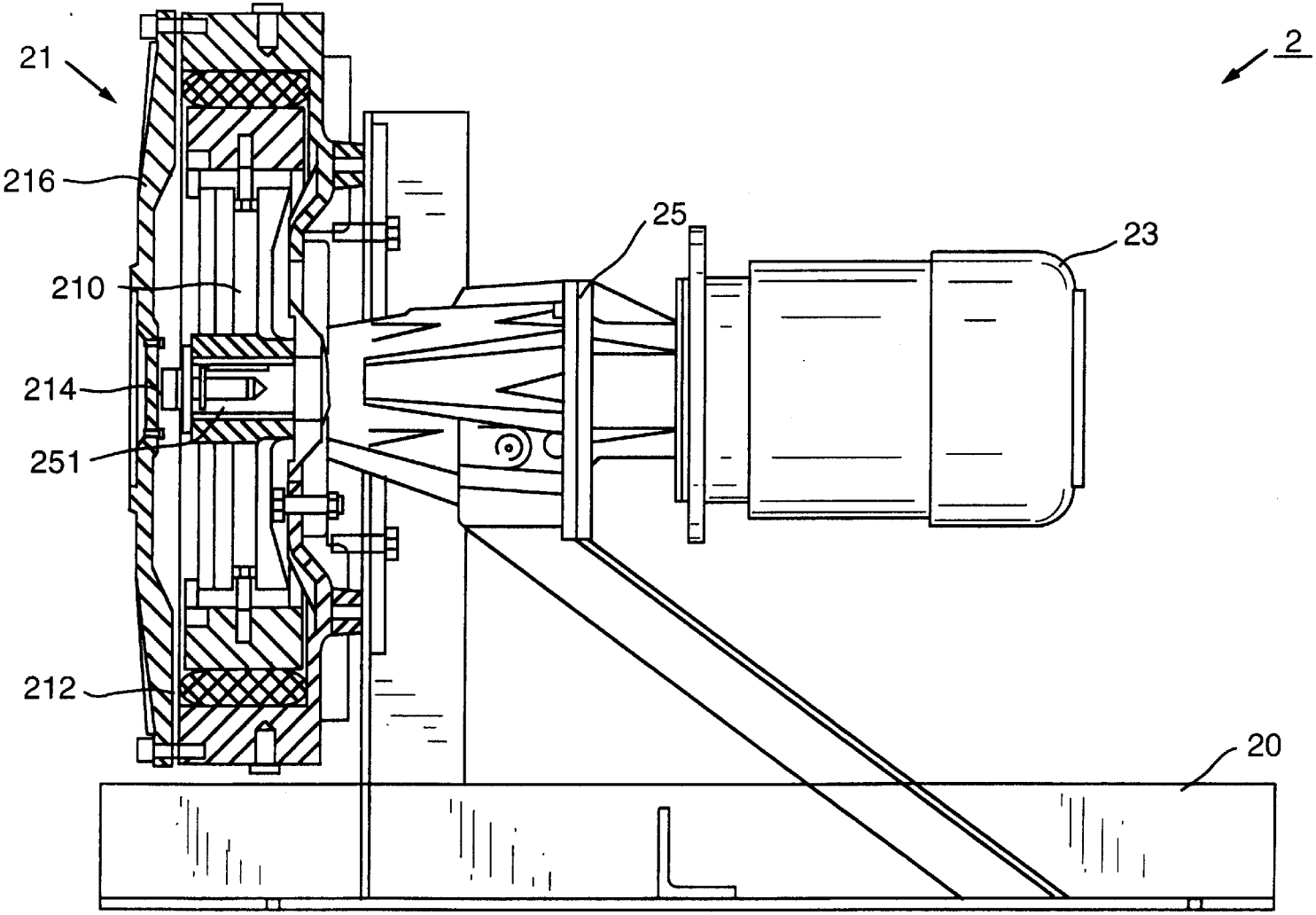
FIG. 2 Prior Art
FIG. 2 shows a sectioned side view of a second prior art pump.

A second prior art pump is shown in FIG. 2. In the pump assembly 2 a pumphead 21 is mounted on a base plate 20. The pumphead includes a rotor 210 which operates to a engage with a flexible tube 212, as in the previous example. A motor 23 drives the rotor by way of a gearbox 25 which is also attached to the base plate 20. The gearbox 25 has an output shaft 251 which engages with the center of the rotor 210 and is held in place by way of a bolt 214.

Such a pump has the advantage that there is no difficulty in aligning the gearbox 10 and the rotor. However, changing of the gear motor assembly 23, 25 requires the cover 216 of the pumphead 21 to be removed, which requires the lubricating fluid within the pumphead to be drained and the pressing shoes and rotor to be removed. The rotor must be removed since it is held in position only by the shaft 251.

Figure 3:
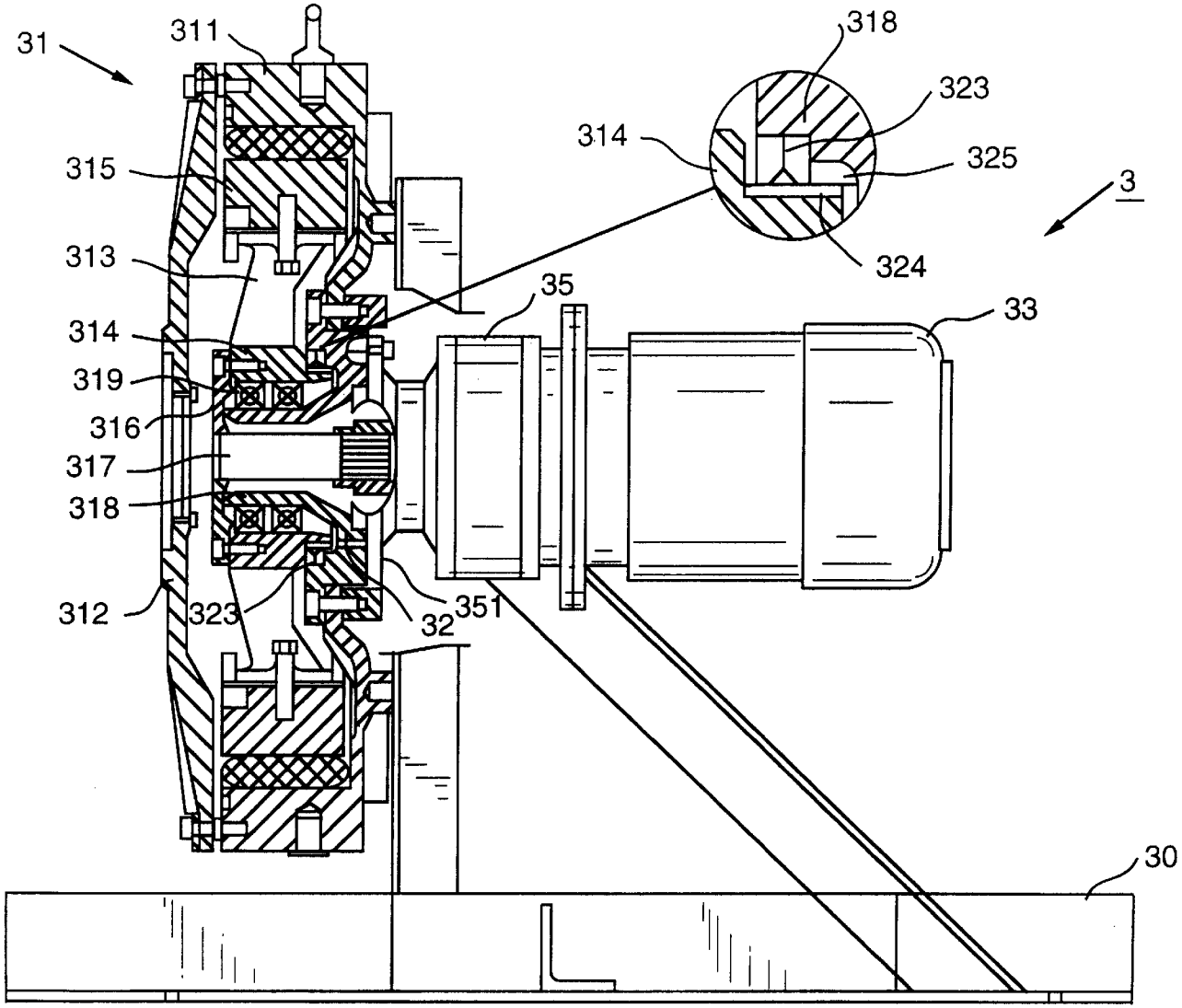
FIG. 3 shows a section side view of a first pump embodying the present invention.
Figure 4:
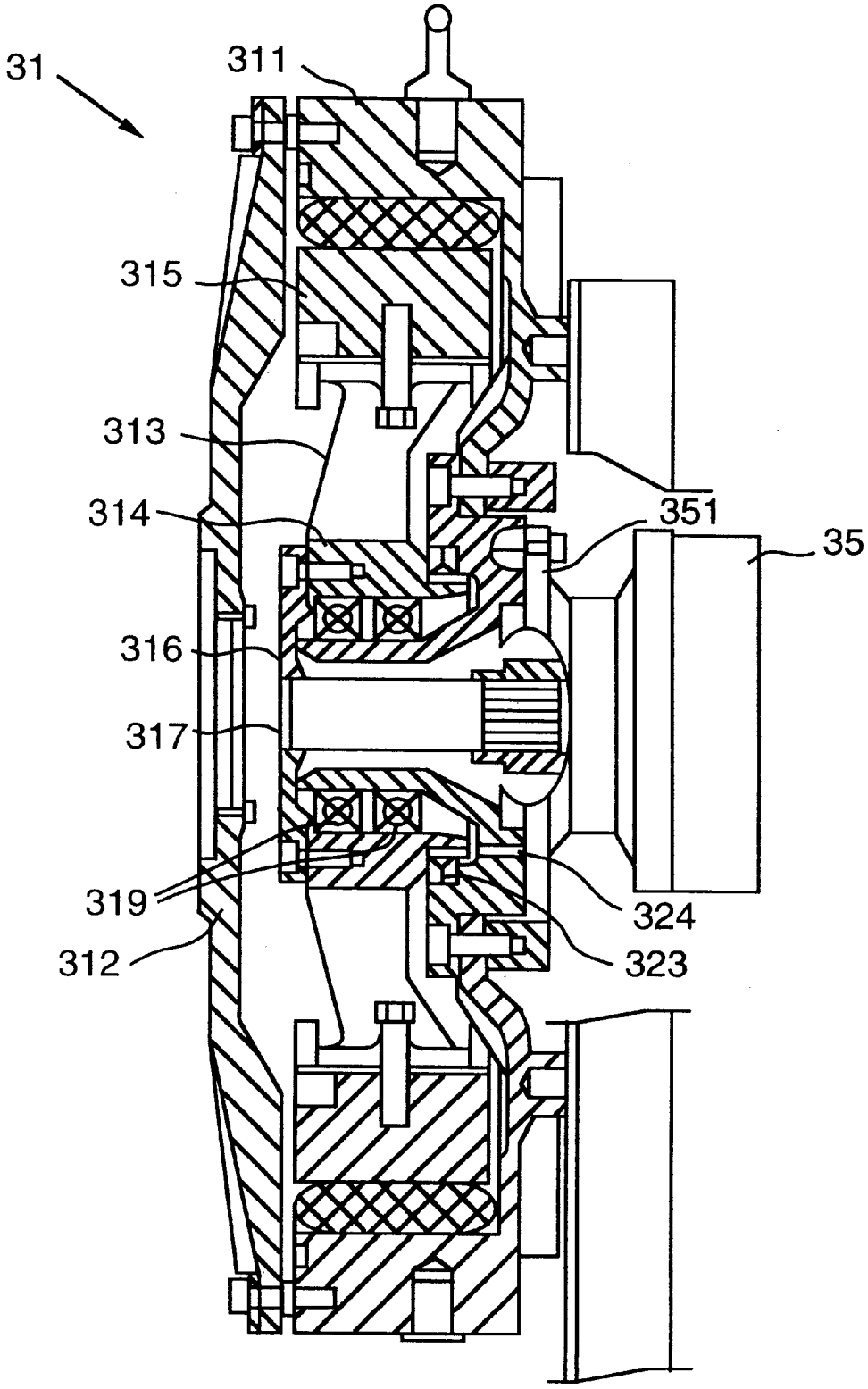
FIG. 4 shows an enlarged section view of the pumphead of FIG. 3.
Figure 5:
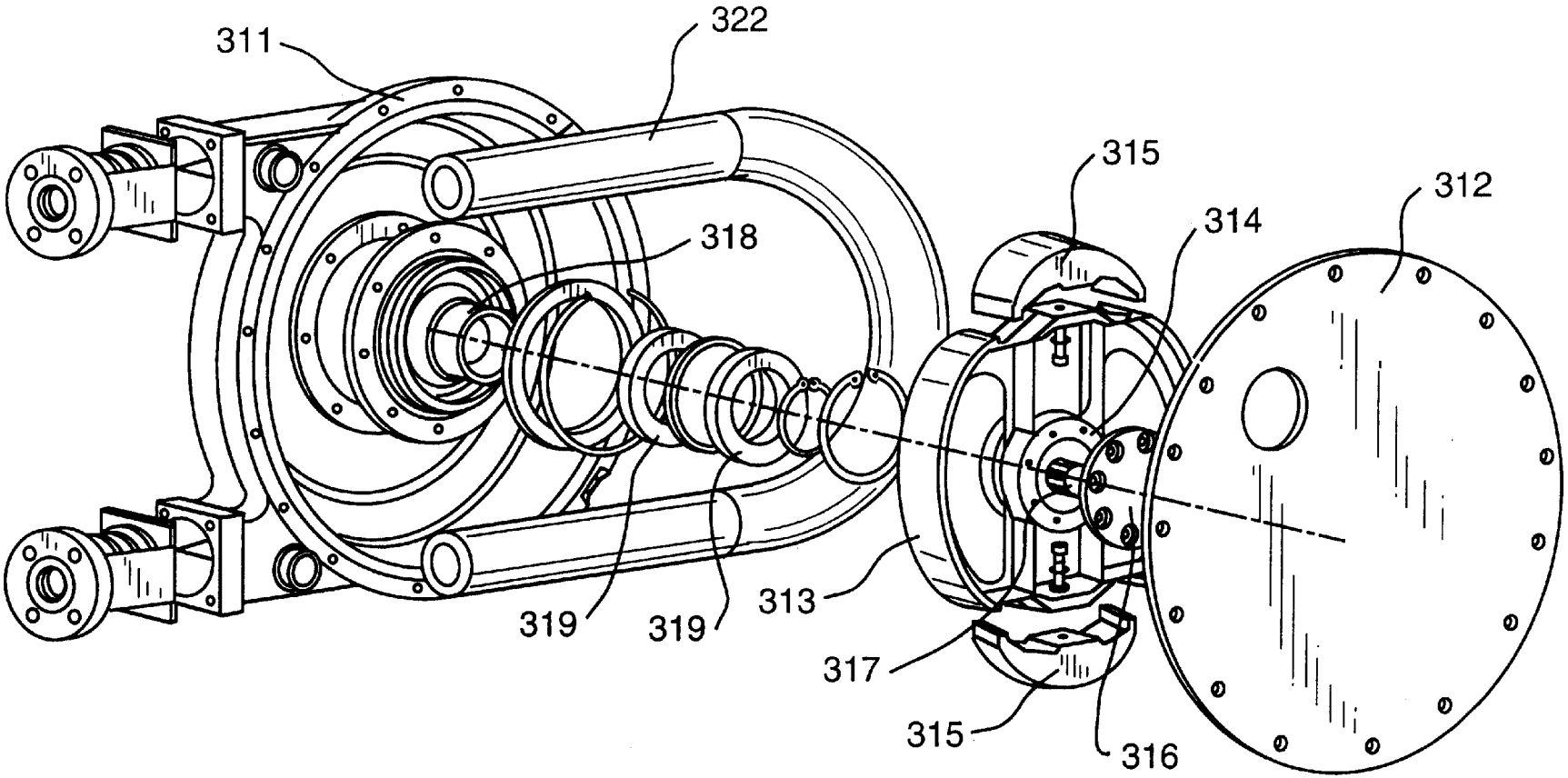
FIG. 5 shows an exploded view of the pumphead of FIGS. 3 and 4.

A first pump 3 embodying the present invention is shown in FIGS. 3, 4 and 5, and comprises a pumphead 31 which is driven by a motor 33 via a gearbox 35. The pump arrangement is carried by a base plate 30.

The pumphead 31 includes a rotor 313 which carries shoes 315 in conventional manner. The rotor 313 has a central region 314 for mounting a drive plate 316 from which extends a driveshaft 317. A mounting hub 318 projects from the pumphead body 311 and supports bearings 319 about which the central region 314 of the rotor 313 rotates. The driveshaft 317 extends, unsupported except by the drive plate 316, through the hub 318.

A cover plate 312 attaches to the pumphead body 311 to provide a sealed unit in which the rotor rotates. The sealed unit contains lubricant to reduce wear on the rotor shoes 315 and the tube 322.

The gear motor assembly 33, 35 is bolted to the outer side of the hub 318 by way of a mounting flange 351. The mounting flange 351 is integral with the gearbox 35 and so the gearbox 35 and motor 33 are rigidly attached to the pumphead assembly 31. An output shaft from the gear box extends into the hub 318 to engage with the driveshaft 317.

The rotor 313 is rotated about the hub 318 on the bearings 319 by the motor and gearbox arrangement 33 and 35. The gearbox output shaft is readily aligned with the driveshaft 317 of the rotor 313 by virtue of the fixed nature of the flange 351 and the hub 318.

In addition, it is simple to remove the gear drive assembly 33 and 35 from the pumphead assembly 31, since the gear box is directly mounted to the outside of the pumphead assembly. Removal of the gearbox does not in any way affect the positioning of the rotor 313 since the rotor 313 is held rotatably on the hub 318.

A seal 323 and wear ring 324 are provided between the central mounting portion 314 of the rotor 313 and the hub 318. The seals 323 prevent leakage of internal lubricant into the bearings 319. The wear ring 324 is provided on the rotor 313 in order to prevent undue wear of the rotor's central portion 314. The ring 324 is relatively easily replaced.

In addition, a controlled leak path 325 is provided so that if the seal 323 fails there is an immediate and obvious indication provided by controlled leaking of lubricant. This early warning of seal failure means that excessive wear of the bearings 319 can be prevented by early replacement of the seal 323.

Thus, a pumphead embodying the present invention includes a rotor which is supported on integral bearings on a hub which is fixedly attached to the pumphead body. A driveshaft extends from the rotor and a gearbox is bolted to the outer surface of the hub in order that its output driveshaft can engage with the rotor driveshaft.

Figure 6:
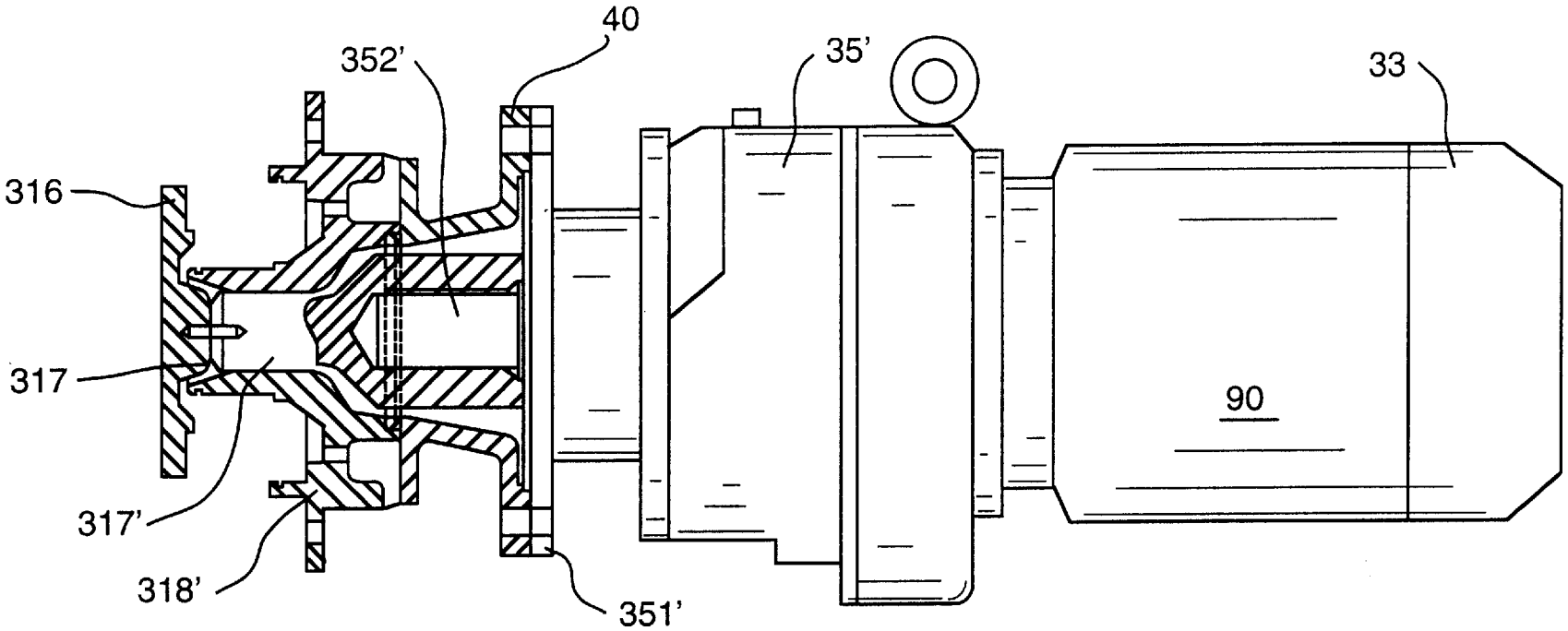
FIG. 6 shows a side sectioned view of part of a second pump according to the present invention.

FIG. 6 shows a partial side view of a second embodiment of the present invention, in which a standard helical drive gearbox 35' is fitted to a rotor embodying the present invention. The rotor carries drive plate 316 from which driveshaft 317 extends as before. A conversion plate 40 is provided between the hub 318' and the flange 351' of the gearbox 35'. A conversion driveshaft 317' and a helical output shaft 352' allow the pumphead embodying the present invention to be used with a conventional helical gearbox 35'.

Figure 7:
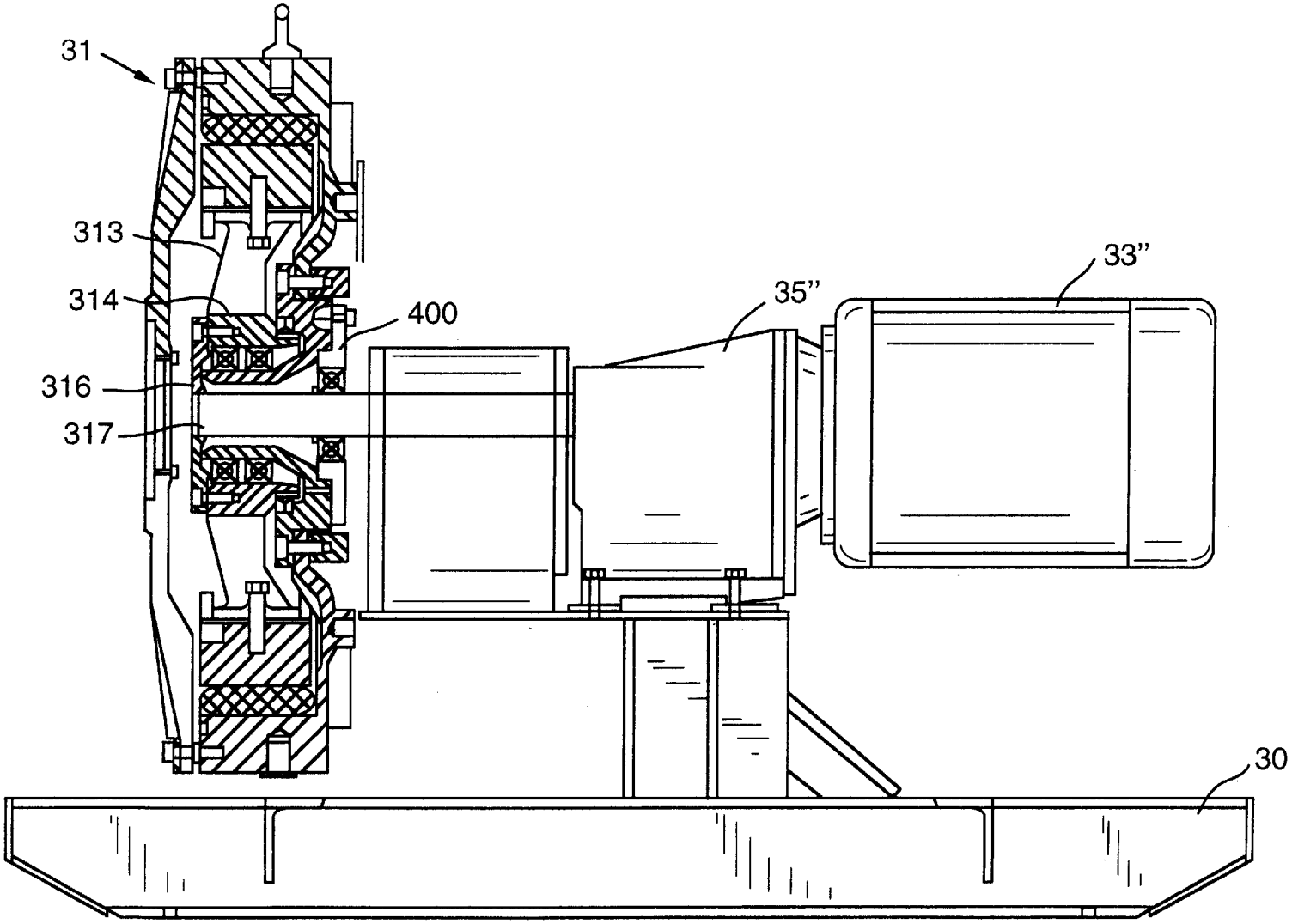
FIG. 7 shows a sectional side view of a third pump embodying the present invention.

FIG. 7 shows a pump similar to the FIG. 1 pump, including a converter 400 enabling use with a pumphead embodying the present invention. The converter allows such a pumphead to be driven, by a bareshaft drive system. The converter 400 includes a flange portion for attachment to the outer surface of the hub, and a set of bearings for aligning the driveshaft 317 from the rotor 31. The gearbox and motor assembly is attached to the driveshaft via a coupling, as in the FIG. 1 pump.

Figure 8:
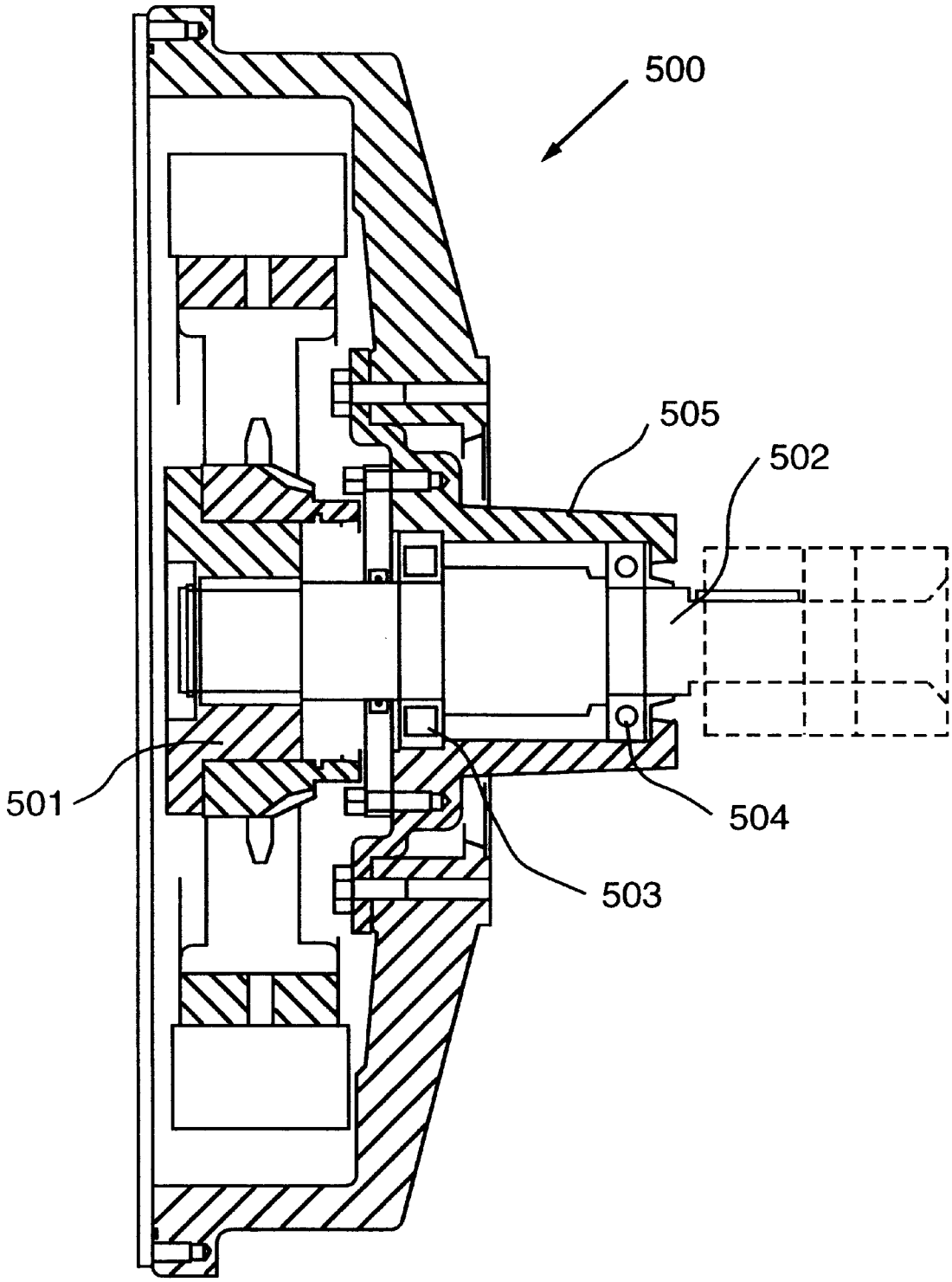
FIG. 8 shows a partial side view of a fourth pump embodying the present invention.

FIG. 8 shows a partial side view of another conversion of the pumphead embodying the present invention for use with a bareshaft drive system. The FIG. 8 system 500 includes a drive portion 501 from which a driveshaft 502 extends. A hub portion 505 is bolted to the pumphead body and carries bearings 503, 504. The bearing 503, 504 support the driveshaft 502 which is then able to be driven by a bareshaft drive system.

Figure 9:
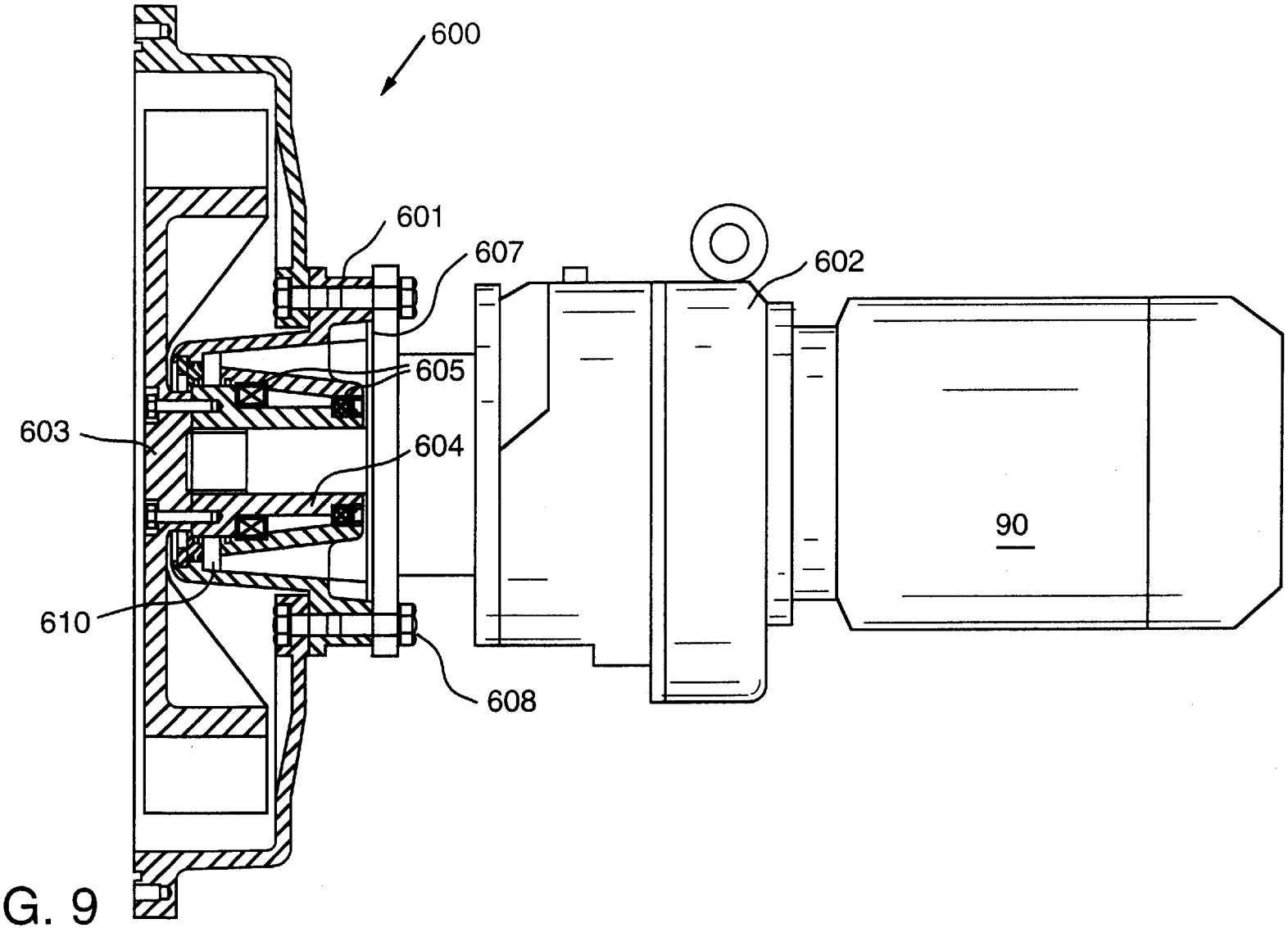
FIG. 9 shows a side view of a fifth pump embodying the present invention.

FIG. 9 shows a side view of another pump embodying the present invention. The pump includes a pumphead 600 and a gear motor assembly 602. As in the previously described systems, a rotor 603 is held for rotation within the pump head 600. A hub 601 is bolted to the pumphead body so that it is rigidly attached thereto. A hollow keyway driveshaft 604 extends from the rotor 601, and is supported within the hub on bearings 605. The rotor is therefore able to spin freely about the hub within the pumphead.

The gear motor assembly 602 is bolted to the hub 601 by means of a mounting flange 607 and bolts 608. The gear motor 602 includes an output shaft which extends into the hollow driveshaft 604 of the rotor assembly. The rotor can therefore be driven by the gear motor assembly.

The FIG. 9 embodiment has advantages similar to those of previously embodiments, namely that the gear motor assembly can be unbolted from the pump head, without the need to disturb the rotor from its place within the pumphead. This is achieved by supporting the rotor on a fixed hub, independently of the gear motor.

The embodiment of FIG. 9 also includes a controlled leak path 610 which enables control leakage of the pumphead lubricating fluid before that fluid reaches the rotor bearings 605.

Figure 10:
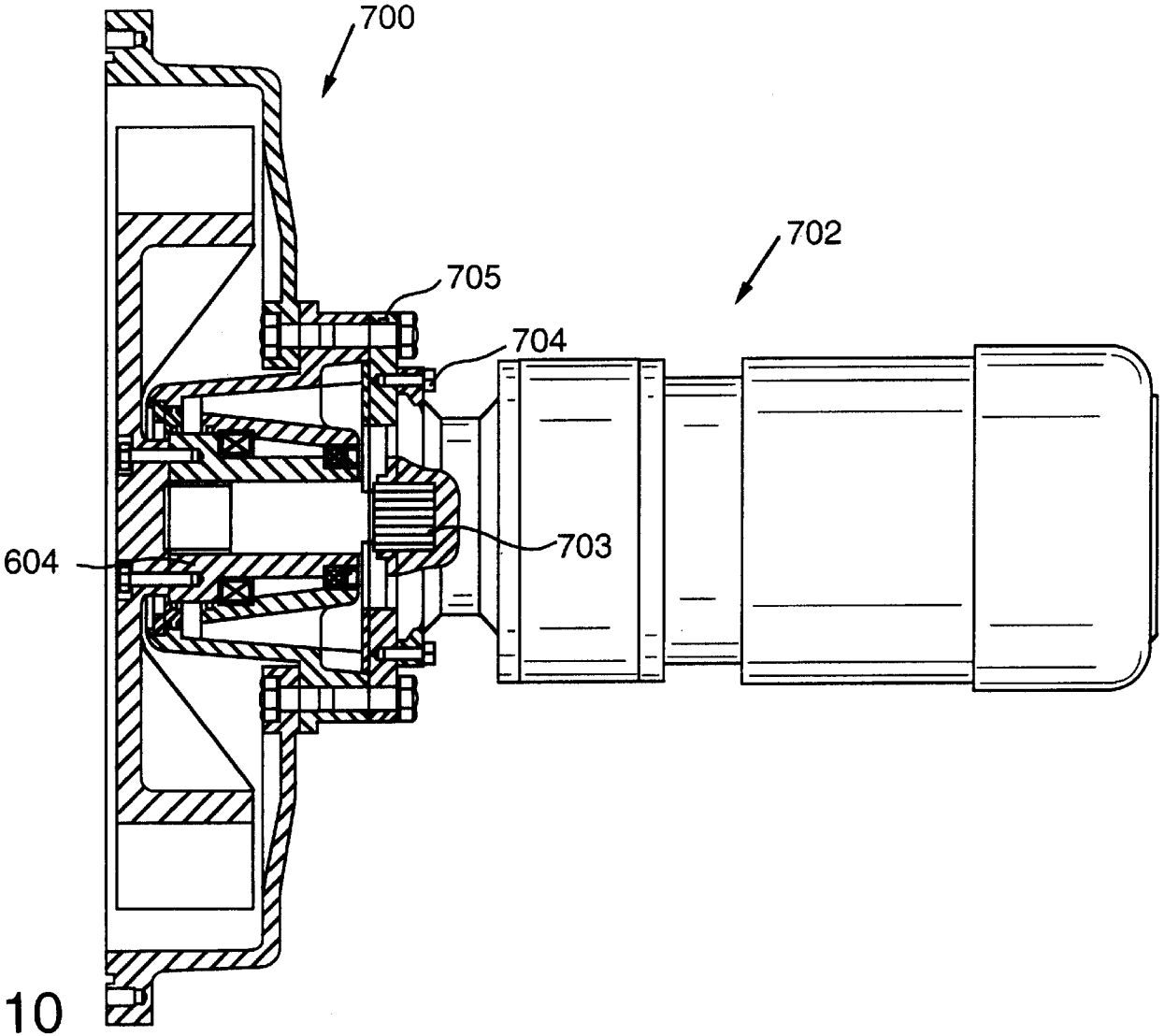
FIG. 10 shows a side view of a sixth pump embodying the present invention.

FIG. 10 shows a view of a pumphead similar to that of FIG. 9 but for use with a planetary gearbox assembly 702. The FIG. 10 pumphead 700 includes an adaptor shaft 703 which adapts the keyway shaft 604 to a splined output shaft. In the FIG. 10 embodiment the gear motor assembly 702 is bolted, by way of bolts 704, to a hub end cover 705.

The FIG. 10 embodiment enables a planetary gear motor to be used with a pumphead which embodies the present invention.

Figure 11:
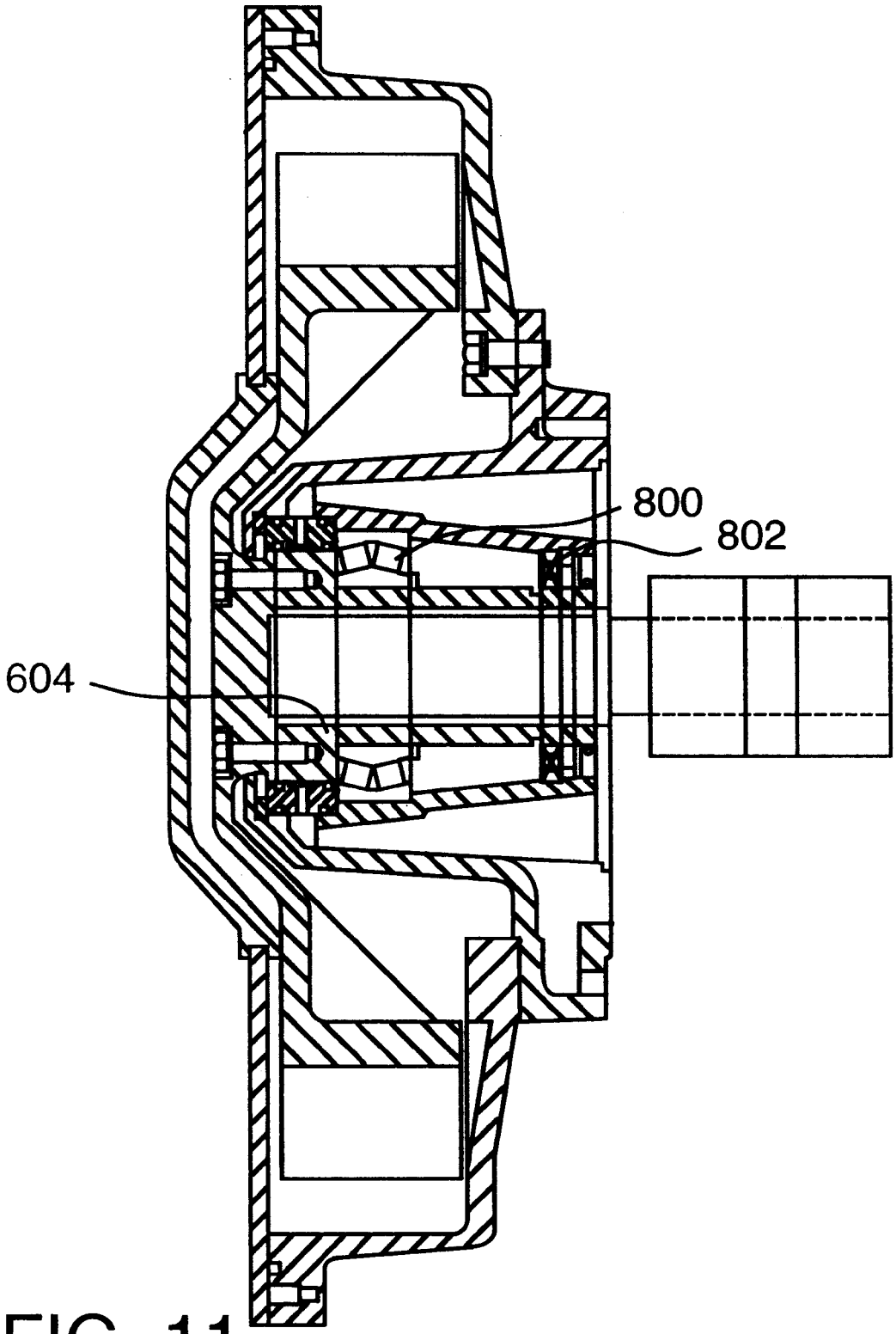
FIGS. 11, 12 and 13 show modifications of the pumpheads of FIGS. 8, 9 and 10 respectively.
Figure 12:
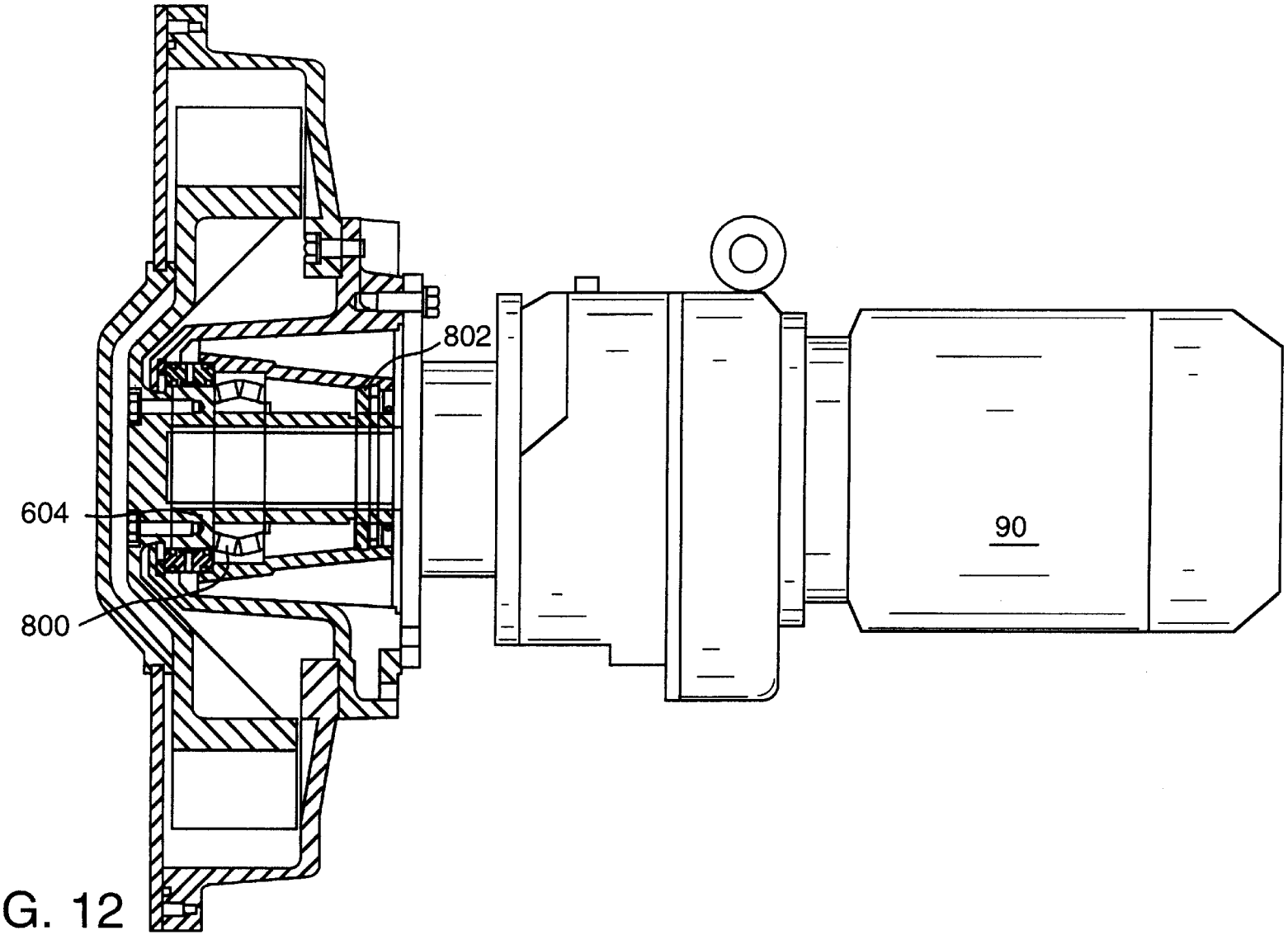
Figure 13:
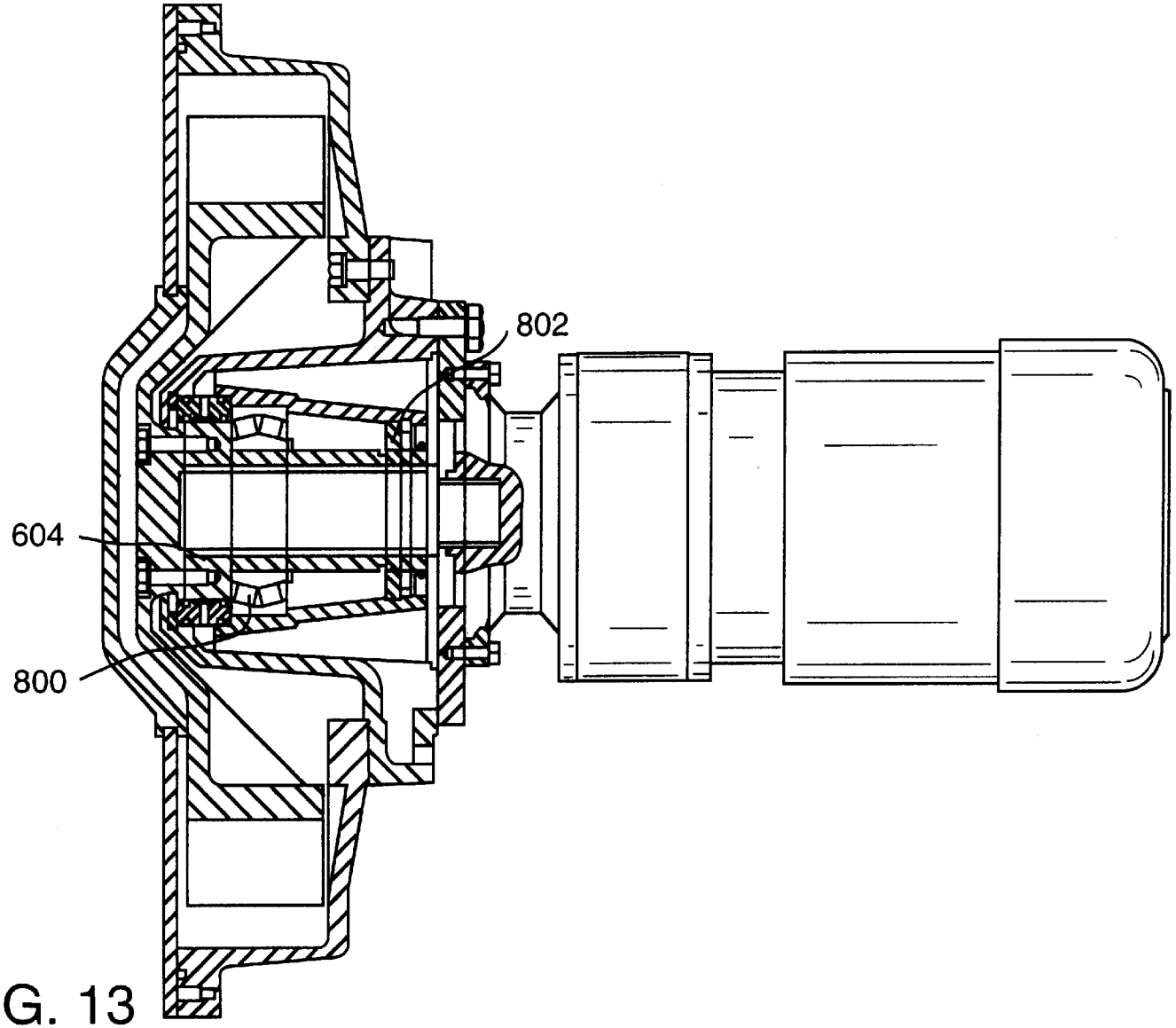

FIGS. 11, 12 and 13 show pumpheads which are modified versions of those shown in FIGS. 8, 9 and 10 respectively.

In FIGS. 11, 12 and 13 the driveshaft 604 which extends from the rotor through the hub is supported by a self aligning double row spherical roller bearing 800. This has the advantage that any mis-alignment of the gear motor output shaft can be allowed for, without further adjustment.

In addition, the FIG. 11, 12 and 13 embodiments include a driveshaft support 802 which is used when the gear motor assembly is removed from the pump.

What is claimed is:

1. A peristaltic pumphead comprising:

a pumphead body having a hub;

a rotor;

said rotor rotatably mounted on said hub for rotation within the pumphead body;

a flexible tube disposed between the rotor and the pumphead body;

said rotor contacting and compressing a portion of said flexible tube;

a mounting portion on said pumphead body;

said pumphead body structured to independently support a drive assembly and the rotor;

a drive shaft extending through the hub structured to connect a drive assembly and the rotor; and wherein the driveshaft extends unsupported through the hub.

2. A pumphead as claimed in claim 1, wherein the driveshaft extends through the hub and is supported on bearings within the hub.

3. A pumphead as claimed in claim 2 wherein the rotor is supported on bearings on an outer surface of the hub.

4. A pumphead as claimed in claim 2 wherein the rotor comprises a main portion which carries tube engaging lobe portions and a central portion which carries the said driveshaft.

5. A peristaltic pump comprising a drive assembly, and a peristaltic pumphead as claimed in claim 2.

6. A pumphead as claimed in claim 1, wherein the rotor is supported on bearings on an outer surface of the hub.

7. A pumphead as claimed in claim 6 wherein the rotor comprises a main portion which carries tube engaging lobe portions and a central portion which carries the said driveshaft.

8. A pumphead as claimed in claim 7 further comprising a seal between the hub and the rotor.

9. A peristaltic pump comprising a drive assembly, and a peristaltic pumphead as claimed in claim 6.

10. A pumphead as claimed in claim 1, wherein the rotor comprises a main portion which carries tube engaging lobe portions and a central portion which carries the said driveshaft.

11. A peristaltic pump comprising a drive assembly, and a peristaltic pumphead as claimed in claim 10.

12. A pumphead as claimed in claim 1 further comprising a seal between the hub and the rotor.

13. A peristaltic pump comprising a drive assembly, and a peristaltic pumphead as claimed in claim 12.

14. A peristaltic pump comprising a drive assembly, and a peristaltic pumphead as claimed in claim 1.

15. A pumphead as claimed in claim 1 wherein the rotor is supported on bearings on an outer surface of the hub.

16. A pumphead as claimed in claim 1 wherein the rotor comprises a main portion which carries tube engaging lobe portions and a central portion which carries the said driveshaft.

17. A peristaltic pump comprising a drive assembly, and a peristaltic pumphead as claimed in claim 1.

18. A peristaltic pumphead comprising:

a pumphead body having a hub and a mounting portion on said pumphead body structured to support a drive assembly;

a rotor;

said rotor rotatably mounted on said hub for rotation within the pumphead body;

a flexible tube disposed between the rotor and the pumphead body;

said rotor contacting and compressing a portion of said flexible tube;

said pumphead body structured to independently support a drive assembly and the rotor;

a drive shaft extending through the hub and structured to connect a drive assembly to the rotor; and a wear ring located between the seal and the rotor, the wear ring being rotatable with the rotor.

19. A pumphead as claimed in claim 18 comprising a lubricant drain path for allowing lubricant held in the pumphead body to drain away from the bearing in the event of seal failure.

20. A peristaltic pump comprising a drive assembly, and a peristaltic pumphead as claimed in claim 18.

21. A peristaltic pumphead comprising:

a pumphead body having a hub and a mounting portion on said pumphead body structured to support a drive assembly;

a rotor;

said rotor rotatably mounted on said hub for rotation within the pumphead body;

a flexible tube disposed between the rotor and the pumphead body;

said rotor contacting and compressing a portion of said flexible tube;

said pumphead body structured to independently support a drive assembly and the rotor;

a drive shaft extending through the hub and structured to connect a drive assembly to the rotor;

a seal between the hub and rotor; and a lubricant drain path for allowing lubricant held in the pumphead body to drain away from the bearing in the event of seal failure.

22. A peristaltic pump comprising a drive assembly, and a peristaltic pumphead as claimed in claim 21.

23. A peristaltic pump comprising:

a pumphead body having a hub and a mounting portion;

a rotor;

said rotor rotatably mounted on said hub within the pumphead body;

a flexible tube disposed between the rotor and the pumphead body;

a drive assembly;

said drive assembly mounted on said mounting portion such that the drive assembly is solely supported by the pumphead, the rotor and drive assembly are supported independently of one another on the pumphead body;

a drive shaft extending through the hub so as to connect the drive assembly and the rotor; and wherein the driveshaft extends unsupported through the hub.

24. A peristaltic pumphead comprising:

a pumphead body having a hub and a mounting portion on said pumphead body structured to support a drive assembly;

a rotor;

said rotor rotatably mounted on said hub for rotation within the pumphead body;

a flexible tube disposed between the rotor and the pumphead body;

said rotor contacting and compressing a portion of said flexible tube;

said pumphead body structured to independently support a drive assembly and the rotor;

a drive shaft extending through the hub and structured to connect a drive assembly to the rotor;

the rotor is supported on bearings on an outer surface of the hub;

the rotor comprises a main portion which carries tube engaging lobe portions and a central portion which carries said driveshaft;

a seal between the hub and the rotor; and a wear ring located between the seal and the rotor, the wear ring being rotatable with the rotor.

* * * * *